United States Patent [19]

Furuya et al.

[11] 4,090,876

[45] May 23, 1978

[54] COLOR CORRECTED LATENT ELECTROSTATIC IMAGES FORMED USING ION-BEAM SCREEN, PLURAL EXPOSURES

[75] Inventors: Tutomu Furuya, Kawasaki; Shigeru Inowa, Hino, both of Japan

[73] Assignee: Konishiroku Photo Industry Co., Ltd., Tokyo, Japan

[21] Appl. No.: 815,152

[22] Filed: Jul. 13, 1977

[30] Foreign Application Priority Data

Jul. 19, 1976 Japan ..... 51-84983
Jul. 19, 1976 Japan ..... 51-84984

[51] Int. Cl.[2] ..... G03G 13/22

[52] U.S. Cl. ..... 96/1 R; 96/1.2; 96/1.3; 355/3 SC

[58] Field of Search ..... 96/1 R, 1.2, 1 M, 1.3; 355/4, 3 SC

[56] References Cited

U.S. PATENT DOCUMENTS

| | | | |
|---|---|---|---|
| 3,680,954 | 8/1972 | Frank | 96/1 R X |
| 3,884,686 | 5/1975 | Bean | 96/1.2 X |
| 3,910,789 | 10/1975 | Hastwell | 96/1.2 |
| 4,006,983 | 2/1977 | Pressman et al. | 355/4 |

*Primary Examiner*—John D. Welsh
*Attorney, Agent, or Firm*—James E. Nilles

[57] ABSTRACT

A process for forming electrostatic latent images to be developed by a color toner. The process comprises steps of electrically charging a photoconductive layer of an ion-beam controlling screen, exposing the photoconductive layer electrically charged to a first image information, disposing a recording medium having a photoconductive layer so as to oppose to the exposed photoconductive layer, and applying ions to the photoconductive layer of the recording medium through the screen to form an electrostatic latent image having a background of charged potential. The photoconductive layer of the recording medium in which the electrostatic latent image is formed is exposed to a second image information to produce a corrected electrostatic latent image.

9 Claims, 16 Drawing Figures

Figure 6:
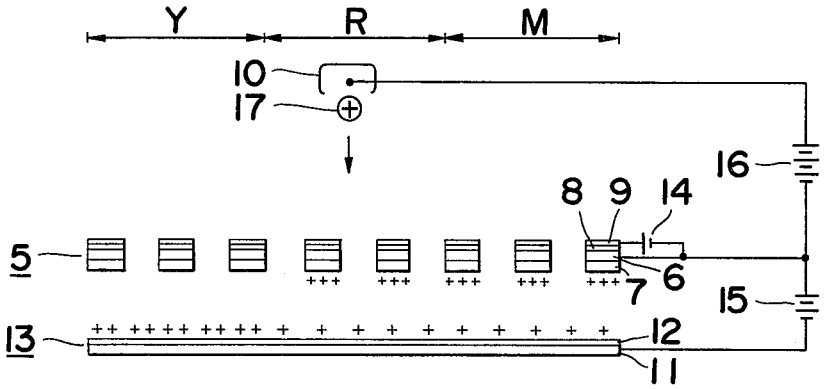

FIG. 1
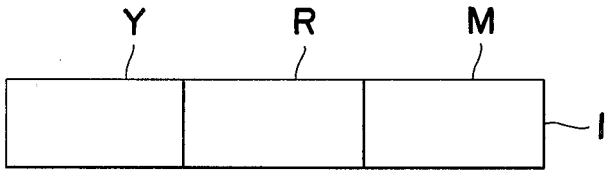
FIG. 2A
FIG. 2B
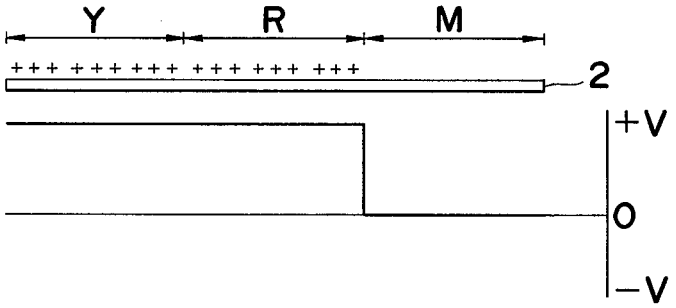
FIG. 3A
FIG. 3B
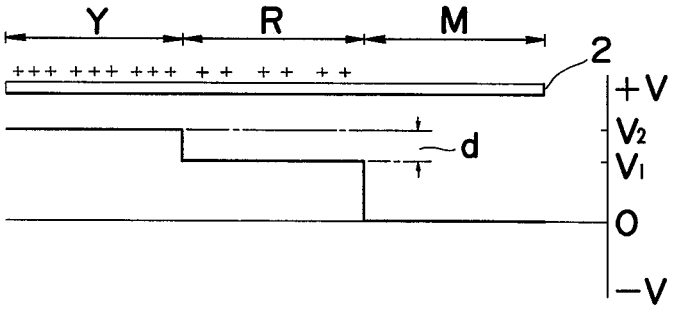
FIG. 4A
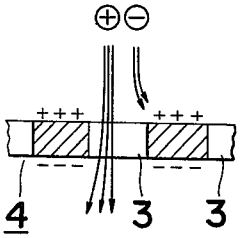
FIG. 4B
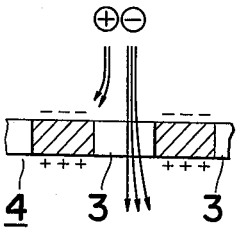
FIG. 5
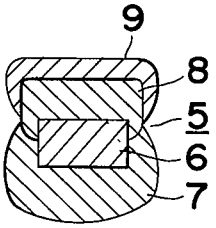

COLOR CORRECTED LATENT ELECTROSTATIC IMAGES FORMED USING ION-BEAM SCREEN, PLURAL EXPOSURES

The present invention relates to a process for forming electrostatic latent images. More particularly, the invention relates to a process for forming on a recording material an electrostatic latent image corresponding to an image information obtained by synthesizing a plurality of image informations.

In general, the subtractive color process is used in the color electrophotography. According to this subtractive color photographic process, a color original is separated into blue, green and red images by three color-separating filters, electrostatic latent images corresponding to the respective separated images are formed, the respective electrostatic latent images are developed by corresponding color toners, namely yellow, magenta and cyan toners, and a copied image reproducing the color original is obtained by superimposing substantially these three toner images.

However, since each of the toners fails to have ideal light-absorbing characteristics, only by superimposing the respective toner images a copied image reproducing the color original faithfully cannot be obtained. For example, when a color original 1 having a yellow area Y, a red area R and a magenta area M as shown in FIG. 1 is reproduced according to the subtractive color photography, the yellow area Y is reproduced by a yellow toner, the red area R is reproduced by yellow and magenta toners and the magenta area M is reproduced by a magenta toner. However, a blue light that must be absorbed only by the yellow toner is also absorbed by the magenta toner and therefore, a developed image area corresponding to the red area R becomes yellowish.

This disadvantage will be eliminated by subtracting the quantity $Q_2$ of the blue light absorbed by the applied magenta toner from the quantity $Q_1$ of the blue light absorbed by the yellow toner to be applied according to the separated blue image information and applying the yellow toner in a quantity corresponding to the above difference $(Q_1 - Q_2)$. In order to accomplish this color correction simply, it is necessary to form an electrostatic latent image having the surface potential controlled according to this color correction, on a recording material which is to be developed by application of the yellow toner. More specifically, as shown in FIG. 2, the surface of a recording material 2 having a photoconductive layer is uniformly charged, for example, positively and it is then exposed to light through the blue separated image. After this treatment charges are left on areas corresponding to the yellow area Y and red area R shown in FIG. 1. In this case, it is necessary to form an electrostatic latent image in which the potential $V_1$ of the area corresponding to the red area R is lower than the potential $V_2$ of the area corresponding to the yellow area Y by the value *d* corresponding to the quantity of the magenta toner applied, namely the value *d* inversely proportional to the quantity of exposure through the green separated image, as shown in FIG. 3. In the drawing, the intensity of the potential is indicated by the density of distribution of symbols (+) and (−) for convenience's sake.

However, it is practically very difficult to obtain an electrostatic latent image in which two image informations are subtractively superimposed as shown in FIG. 3, though it is theoretically possible. For example, in order to obtain an electrostatic latent image in which a yellow toner image where the above-mentioned color correction has already been made is directly formed, it is theoretically sufficient to perform exposure of a blue separated image positive and exposure of a green separated image negative in the superimposed state after charging of a recording material, but practically, exposure of a negative is very difficult. Even if exposure of a negative is substantially attained by using the original as the negative or by conducting development according to the reversal process, since also exposure of the positive is necessary and a positive-negative relation must be established between the image of a mask used for exposure and the separated image to be exposed, reversal exposure is indispensable at any rate. It is very difficult to accomplish this reversal exposure according to ordinary optical means.

It is therefore a primary object of the present invention to provide a process in which an electrostatic latent image corresponding to subtractive superposition of a plurality of image informations can easily be formed.

Another object of the present invention is to provide a process in which an electrostatic latent image identical with one that is obtained by exposing two of three separated color images of a color original subtractively on one uniformly charged photoconductive layer and is therefore capable of providing a color-corrected copied image on development can be formed very easily.

Figure 7:
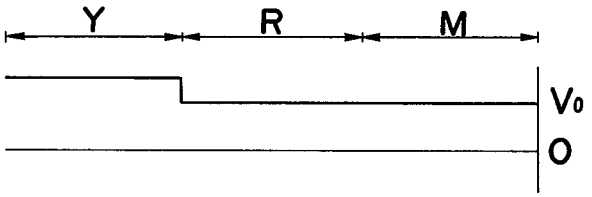
Figure 8:
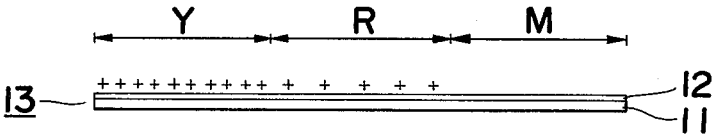
Figure 9:
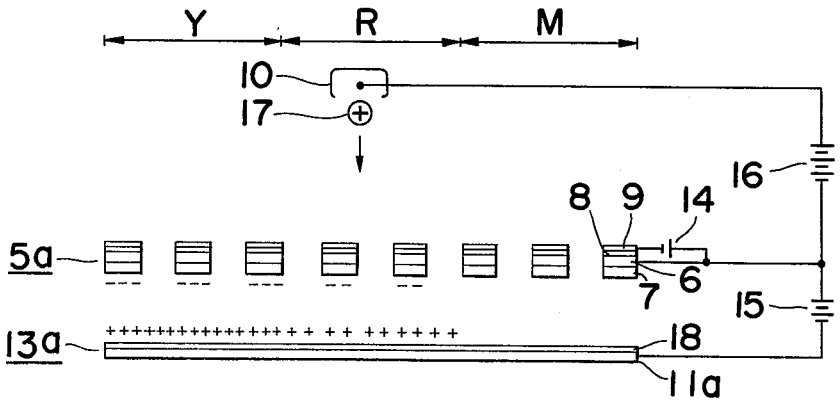

Other objects, features and advantages of the present invention will be apparent from the detailed description made hereinafter by reference to the accompanying drawings, in which:

FIG. 1 is a view illustrating a color original;

FIGS. 2-A and 2-B are a view and graph illustrating diagrammatically the potential state of an electrostatic latent image free of a correction corresponding to the color correction, which corresponds to the original shown in FIG. 1;

FIGS. 3-A and 3-B are a view and graph illustrating the potential state of an electrostatic latent image including a correction corresponding to the color correction, which corresponds to the original shown in FIG. 1;

FIGS. 4-A and 4-B are views illustrating the principle of the operation of a screen that is used in the present invention;

FIG. 5 is a sectional view showing an example of the screen that can be used in the present invention;

FIG. 6 is an illustration explanatory of a method of forming electrostatic latent image, the method being a first embodiment of the invention, FIG. 7 is a graphical representation of the potential state of an electrostatic image obtained by an application of ions in the course of the method as illustrated in FIG. 6, FIG. 8 is an illustration explanatory of the potential state of an electrostatic latent image formed by the method of the first embodiment, FIG. 9 is an illustration explanatory of a second embodiment of the invention, and FIGS. 10 through 13 are illustrations explanatory of a third embodiment of the invention.

A photoconductive screen for controlling ion beam, that is used in the present invention, will now be described.

In general, as shown in FIG. 4-A, in the state where one face of a net member 4 having numerous penetrating holes 3 is positively charged and the other face of the net member 4 is negatively charged, a peripheral electric field is generated in the space surrounding each penetrating hole 3, and charged particles directed to pass through the penetrating hole 3 are influenced by the intensity and direction of this electric field. For example, when cations + are applied from the side of one face of this net member 4, the cations + pass through the penetrating holes 3 and arrive at the side of the other face, but anions − are attracted by positive charges on said one face and bonded thereto and they disappear and do not arrive at the side of the other face. In contrast, when cations + are applied from the side of the other face of the net member 4, as shown in FIG. 4-B, they are intercepted, but anions − are allowed to pass through the net member 4. The quantity of ions passing through the net member 4 is changed depending on the intensity of said peripheral electric field, namely the quantities of charges on both the faces of the net member 4 and the intensity of the electric field for accelerating ions to pass through the penetrating holes 3.

The screen that is used in the present invention is to control ion beam based on the above principle, and an example of the screen that is preferably used in the present invention is illustrated in FIG. 5. This screen 5 comprises a photoconductive layer 7 formed on one face of a base 6 composed of a metal lattice having numerous penetrating holes, and an insulating layer 8 is formed on the other surface of the base 6 and a biasing conductive layer 9 is formed on the insulating layer 8.

As the ion beam controlling screen 5 has a particular structure described above, it is possible to form an electrostatic image on the photoconductive layer 7 of the screen 5 with the easily practicable steps. A preferred electrostatic image can be formed by controlling the biasing voltage applied on the biasing conductive layer 9 of the screen 5, and therefore, the quantity of the ions passing through the screen can be controlled precisely corresponding to the original.

In the first embodiment and subsequent embodiments, formation of an electrostatic latent image including a color correction to be developed by a yellow toner is illustrated as an example.

Referring to FIG. 6 schematically illustrating the first embodiment of the invention, a photoconductive layer 7 of a screen 5 is at first uniformly charged with positive electricity, and is then exposed to the image of a color original through a green filter, so that a green separated positive electrostatic latent image is formed by the positive charges on the photoconductive layer 7. Subsequently, an ion source 10 is disposed to confront a biasing layer 9 of the screen 5, while a recording medium 13 consisting of a conductive layer 11 and a photoconductive surface layer 12 is arranged with its surface layer 12 facing the photoconductive layer 7. Then, a positive biasing voltage by means of an electric power source 14 is applied to the biasing layer 9, whereas the conductive layer 11 of the recording medium 13 is kept at a negative potential by another power source 15. Then, the ion source 10 is energized by still another power source 16, so that a scanning is performed radiating cations 17 onto the screen 5.

Since the photoconductive layer 7 of the screen 5 carries the positive image formed by the positive charges, and since the rate of passage of cations 17 through specific regions of the screen 5 increases and decreases depending on the decrease and increase of the positive charges on the photoconductive layer 7, a negative electrostatic image of the aforementioned green separated image is formed by cations 17 having passed through the screen 5, on the photoconductive layer 12 of the recording medium 13.

A background potential to eliminate non-charged region from the electrostatic image is obtained by intensifying an electric field for accelerating cations 17, or by elevating the bias potential by the electric power source 14. In FIG. 7 showing the potential state of the electrostatic image thus obtained, the background potential is denoted by $V_0$.

Subsequently, the photoconductive layer 12 of the recording medium 13 thus carrying the electrostatic image is exposed to the aforementioned color original through a blue filter. The charges on the regions exposed to the light are extinguished by an amount corresponding to the intensity of the exposure. Consequently, an electrostatic latent image corresponding to the condition of FIG. 3 of a potential state as shown in FIG. 8 is formed.

Accordingly, in the electrostatic image thus obtained, the potential of the area to which the yellow toner is to be applied is subtracted in correspondence to the potential of the area to which the magenta toner is to be applied, so that a yellow toner image in which the blue light absorbed by the magenta toner is corrected is obtained when this latent image is developed with the yellow toner.

Referring now to FIG. 9 illustrating the second embodiment, a second screen 5*a* having a similar structure to the first screen 5 is used in place of the recording medium of the first embodiment. An electrostatic image equivalent to that of FIG. 8 is formed on the photoconductive layer 7 of the second screen 5*a*, by the same process with the first embodiment but with negative charges. Another recording medium 13*a* having a conductive carrier 11*a* and an insulating surface layer 18 is disposed to confront the photoconductive layer 7 of the second screen 5*a*. A scanning is effected in the similar manner with the process of FIG. 6, radiating cations 17 onto the another recording medium 13*a*, through the aforementioned second screen 5*a*. It will be seen that the electrostatic image formed on the photoconductive layer 7 of the second screen 5*a* already includes the objective color correction, so that an electrostatic latent image by positive charges of a pattern similar to that on the photoconductive layer 7, i.e. an electrostatic latent image identical to that of FIG. 8, is formed on the insulating surface layer 18 of the recording medium 13*a*.

As has been described, according to the second embodiment of the invention, an electrostatic latent image which can be directly developed is obtained on an insulating surface layer 18, and not on a photoconductive layer, contributing greatly to facilitate the development and to maintain the surface at good condition. Thus, this second embodiment is of a highly practical advantage to ensure a good copy of the image.

In the foregoing embodiments, it is preferable to use the screen 5 having a structure as shown in FIG. 5. However, it is possible to use a screen having other construction, for example a screen having no biasing conductive layer may be used, because it is no need to control exactly the level of the background potential.

Figure 10:
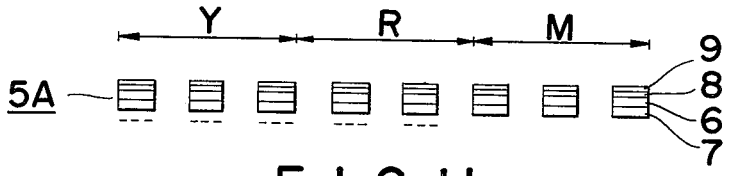
Figure 11:
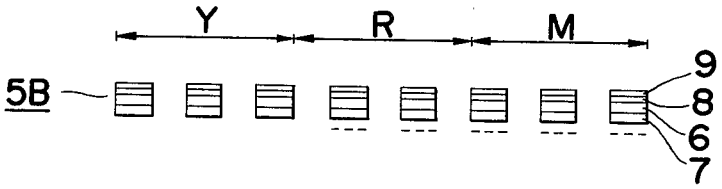

Turning now to FIG. 10 showing a third embodiment of the invention, the photoconductive layer 7 of a first screen 5A which has a same construction as that shown in FIG. 5 is uniformly charged with negative electricity. The charged photoconductive layer 7 is then exposed to the color original image through a blue filter, so as to form a positive electrostatic image of a blue separated image by negative charges on the photoconductive layer 7. Meanwhile, the photoconductive layer 7 of a second screen 5B similar to the first one 5A is uniformly charged to negative, and is exposed to the image of the color original through a green filter, thereby to form a positive electrostatic image of a green separated image on the photoconductive layer 7 of the second screen 5B as shown in FIG. 11. The image is in mirror relation to the electrostatic image formed on the photoconductive layer 7 of the first screen 5A.

Figure 12:
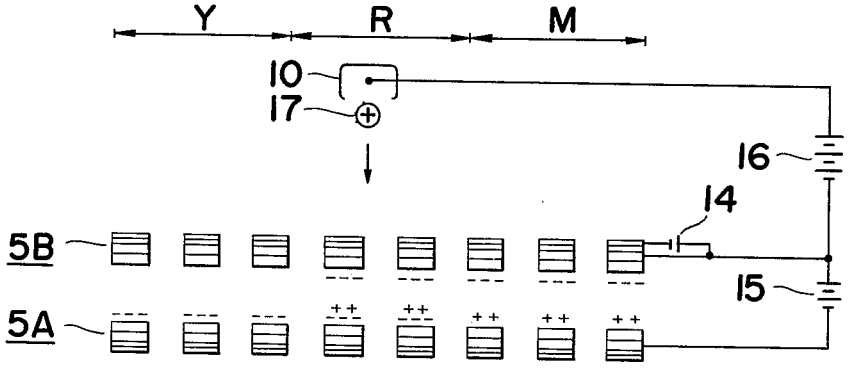

Then, as shown in FIG. 12, an ion source 10 is disposed to confront a biasing conductive layer 9 of the second screen 5B, while the first screen 5A is disposed with its photoconductive layer 7 confronting the same 7 of the second screen 5B. A negative bias potential is applied to the biasing conductive layer 9 of the second screen 5B by means of a power source 14, while a base 6 of the first screen 5A is kept at a potential below that of a base 6 of the second screen 5B, by means of a power source 15. Then, the ion source 10 is energized by a power source 16, so as to effect a scanning with cations 17 radiated onto the second screen 5B.

A positive image has been formed on the photoconductive layer 7 of the second screen 5B, by negative charges. Also, it is recalled that the rate of passage of cations 17 through specific regions of the second screen 5B increases and decreases in accordance with increase and decrease of the negative charges on the photoconductive layer 7. Supposing here that there is no electrostatic image formed on the photoconductive layer 7 of the first screen 5A, a positive electrostatic image of green separated image would be formed by positive charges on that layer as a mirror image. However, actually, the photoconductive layer 7 of the first screen 5A already carries a positive electrostatic image of blue separated image formed by negative charges. Therefore, an electrostatic image is resulted on that layer, which is materially a product of a superimposition of the two electrostatic images. This superimposition is made, of course, in a subtractive manner, because the images have reverse polarities of charges. Consequently, a positive electrostatic image of negative charges corrected in accordance with the green separated image is formed on the photoconductive layer 7 of the first screen 5A.

Figure 13:
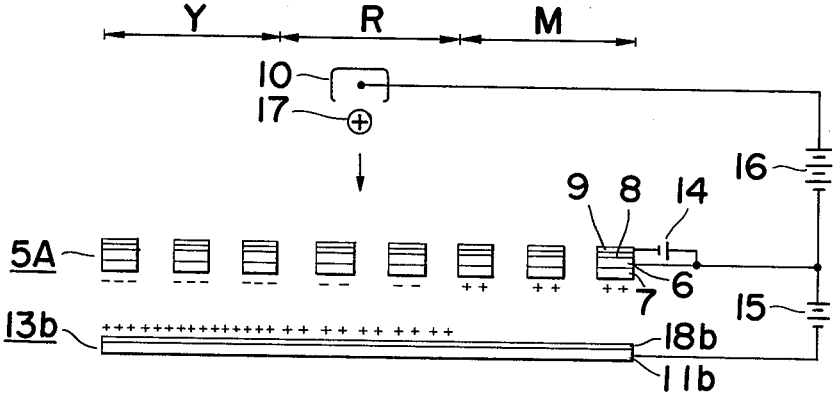

An ion source 10 is disposed, as shown in FIG. 13, so as to oppose to the biasing conductive layer 9 of the first screen 5A. At the same time, a recording medium 13*b* consisting of a conductive layer 11*b* and an insulating surface layer 18*b* is positioned with its surface layer 18*b* facing the photoconductive layer 7. A negative bias voltage is applied to the biasing conductive layer 9 by a power souce 14, while the conductive layer 11*b* of the recording medium 13*b* is kept at a lower potential than a base 6, by means of another power source 15. Then, the ion source 10 is actuated by still another power souce 16, thereby to effect a scanning by means of cations 17 radiated onto the first screen 5A. As a result of this application of cations, an electrostatic image by positive charges, similar to the image formed by negative charges on the photoconductive layer 7 of the first screen 5A, is formed on the insulating surface layer 18 of the recording medium 13*b*. Since the electrostatic image on the photoconductive layer 7 has been corrected already, the electrostatic latent image formed on the insulating surface layer 18*b* consists of a distribution of potential in which the potential of the region to which the yellow toner is to be applied is subtracted in correspondence with the potential of the region to which the magenta toner is to be applied. Namely, the latent image formed on the insulating layer 18*b* has a pattern of potential distribution similar to that of FIG. 3. It will be seen that a yellow toner image in which the blue color absorption by the megenta toner has been corrected is obtained when the latent image is developed by yellow toner.

In the process as described above, the application of cations from the ion source 10 at the step of FIG. 12 may be substituted by an application of anions. Then, the anions pass through the second screen 5B at a rate which increases and decreases in accordance with the decrease and increase of the charges forming the electrostatic image on the photoconductive layer 7 of the second screen 5B. Consequently, an image similar to a product of superimposition of positive image of blue separated image provided by negative charges and a negative image of green separated image constituted by negative charges is formed on the photoconductive layer 7 of the first screen 5A.

This electrostatic image exhibits a potential distribution equivalent to that of the image formed on the first screen 5A in the foregoing embodiment, although they are of different values of potential. Therefore, yellow toner image in which the color correction has been made is obtained by the same developing process with the foregoing embodiment.

As will be seen also from the foregoing description, an electrostatic image similar to a product of a subtractive superimposition of a first and a second electrostatic images can be obtained by a combination of a positive and negative images of the charges of the same polarity, two positive images of the charges of different polarities, or of two negative images of charges of different polarities. It is remarkable that the present invention provides these combinations very easily, without necessitating any reverse exposure.

More specifically, the polarity of the charges forming the electrostatic image on the photoconductive layer 7 of the first screen 5A is the polarity before the exposure. Thus, negative electrostatic image and positive electrostatic image are obtained, respectively, when the polarities of the subsequently applied ions and that of the image on the photoconductive layer 7 are the same and different. Representing here the positive and negative images of an electrostatic image of an image X by $X^+$ and $\overline{X}^+$, respectively, and positive and negative images by negative charges by $X^-$ and $\overline{X}^-$, respectively, the conditions of electrostatic images of the second image II to be combined with respective one of the electrostatic images $I^+$, $I^-$, $\overline{I^+}$ and $\overline{I^-}$ of the first image I, the polarity of the photoconductive layer 7 of the second screen 5B required for obtaining the above-mentioned conditions, and the natures of ions to be applied are as shown in the following table.

As will be read from the table, the photoconductive layer 7 of the second screen 5B for forming the electrostatic image of the second image II is charged to positive when the electrostatic image of the first image I is $I^+$ or $I^-$, and to negative when the latter is $I^-$ or $I^+$, respectively. After the exposure, the superimposed electrostatic latent image of both electrostatic images of the intended combination can be obtained, by an application of either one of the anions and cations.

Table

| Electrostatic Image of First Image | Combination | Polarity of photoconductive layer | Nature of Ion |
|---|---|---|---|
| $I^+$ | $I^+, II^+$ | positive | cation |
| | $I^+, II^-$ | positive | anion |
| $I^-$ | $I^-, II^+$ | negative | cation |
| | $I^-, II^-$ | negative | anion |
| $I^+$ | $I^+, II^+$ | negative | cation |
| | $I^+, II^-$ | negative | anion |
| $I^-$ | $I^-, II^+$ | positive | cation |
| | $I^-, II^-$ | positive | anion |

Thus, according to the third embodiment of the invention, the insulating surface layer 18 of the recording medium 13 is subjected only to a single step of application of ions as shown in FIG. 13 and, therefore, suffers from almost no damage.

Consequently, the surface condition of the recording medium is kept in quite a good order, ensuring a good copy of the image. In addition, the development itself is rendered much easier than in conventional technique in which the photoconductive layer is directly developed, presenting a great practical advantage.

As has been described, according to the invention, an electrostatic latent image of electrostatic images of two kinds of images, superimposed in a subtractive manner, is formed on the recording medium in a very simple way. This advantage promises a quite easy and simple production of an electrostatic latent image in which the correction has been made corresponding to the color correction, when the method is applied to color electrophotography, and, accordingly, a copy of the original image of an enhanced fidelity due to the color correction.

What is claimed is:

1. A process for forming electrostatic latent images comprising steps of electrically charging a photoconductive layer of an ion-beam controlling screen, exposing said photoconductive layer electrically charged to a first image information, disposing a recording medium having a photoconductive layer so as to oppose to the exposed photoconductive layer, applying ions to said photoconductive layer of said recording medium through said screen to form an electrostatic image having a background of charged potential, and exposing said photoconductive layer of said recording medium in which said electrostatic image is formed to a second image information to produce a corrected electrostatic latent image.

2. A process for forming electrostatic images as claimed in claim 1, wherein said first and second image informations are color separated image informations of the same color image.

3. A process for forming color electrophotographs comprising steps of electrically charging a photoconductive layer of an ion-beam controlling screen, exposing the charged photoconductive layer to one of three separated color images of a color original, disposing a recording medium having a photoconductive layer so as to face said charged photoconductive layer, applying ions to said photoconductive layer of said recording medium through said screen to form an electrostatic image having a background of charged potential, exposing said photoconductive layer of said recording medium in which said electrostatic image is formed to one of the remainder two color separated image informations thereby to form a corrected electrostatic latent image in said recording medium, and developing said corrected latent image with toner corresponding to said one of the remainder two color separated image informations.

4. A process for forming electrostatic latent images comprising steps of electrically charging a photoconductive layer of a first ion-beam controlling screen, exposing the charged photoconductive layer to a first image information, disposing a second ion-beam controlling screen having a photoconductive layer so as to face the exposed photoconductive layer, applying ions to said photoconductive layer of said second screen through said first screen thereby to form an electrostatic image having a background of charged potential, exposing said photoconducitve layer of said second screen now carrying the electrostatic image to a second image information thereby to form a corrected electrostatic image, disposing a recording medium to confront said photoconductive layer carrying said corrected electrostatic image, and applying ions to said recording medium through said second screen thereby to form an electrostatic latent image.

5. A process for forming electrostatic latent images as claimed in claim 4, wherein said first and second image informations are color separated image informations of the same color original.

6. A process for forming color electrophotographs comprising steps of electrically charging a photoconductive layer of a first ion-beam controlling screen, exposing the charged photoconductive layer to one of three color separated image informations of a color original, disposing a second ion-beam controlling screen having a photoconductive layer to confront the exposed photoconductive layer, applying ions through said first screen onto said photoconductive layer of said second screen thereby to form in the latter an electrostatic image having a background of charged potential, exposing said photoconductive layer of said second screeen carrying said electrostatic image to one of the remainder two color separated informations thereby to form a corrected electrostatic image, disposing a recording medium to confront said electrostatic layer carrying said corrected electrostatic image, applying ions onto said recording medium through said second screen to form an electrostatic latent image on said recording medium, and developing said latent image with toner corresponding to said one of said two remainder color separated image informations.

7. A process for forming electrostatic latent images comprising steps of:

forming an electrostatic image by at first electrically charging a photoconductive layer of a first ion-beam controlling screen and then exposing the charged photoconductive layer to a first image information;

forming another electrostatic image by electrically charging a photoconductive layer of a second ion-beam controlling screen and then exposing the charged photoconductive layer to a second image information, said photoconductive layer of said second screen being charged to positive when said electrostatic image formed on said photoconductive layer of said first screen is a positive image constituted by positive charges or a negative image constituted by negative charges, and to negative when the latter is a negative image constituted by positive charges or a positive image constituted by negative charges;

forming a corrected electrostatic image by positioning said screens such that their photoconductive layers confront each other, and then applying ions onto said photoconductive layer of said first screen through said second screen; and forming an electrostatic latent image by positioning a recording medium to confront said photoconductive layer carrying said corrected electrostatic image, and then applying ions onto said recording medium through said first screen;

said first ion-beam controlling screen and second ion-beam controlling screen each comprising a base composed of a metal lattice having numerous penetrating holes, a photoconductive layer formed on one surface of the base, an insulating layer formed on the other surface of the base, and a biasing conductive layer formed on the insulating layer.

8. A process for forming electrostatic latent images as claimed in claim 7, wherein said first and second image informations are color separated image informations of the same color original.

9. A process for forming electrophotographs comprising steps of:

forming an electrostatic image by at first electrically charging a photoconductive layer of a first ion-beam controlling screen, and then exposing the charged photoconductive layer to one of three color separated image informations of a color original;

forming another electrostatic image by at first electrically charging a photoconductive layer of a second ion-beam controlling screen, and then exposing the charged photoconductive layer to one of the remainder two color separated image informations, said photoconductive layer of said second screen being charged to positive when said electrostatic image formed in said photoconductive layer of said first screen is a positive image constituted by positive charges or a negative image constituted by negative charges, and to negative when the latter is a negative image constituted by positive charges or a positive image constituted by negative charges;

forming a corrected electrostatic image by disposing said first and second screens such that their photoconductive layers confront each other, and then applying ions onto said photoconductive layer of said first screen through said second screen;

forming an electrostatic latent image by at first placing a recording medium to confront said photoconductive layer carrying said corrected electrostatic image and then applying ions onto said recording medium through said first screen; and developing said electrostatic latent image with a toner corresponding to said one of said two remainder color separated image informations;

said first ion-beam controlling screen and second ion-beam controlling screen each comprising a base composed of a metal lattice having numerous penetrating holes, a photoconductive layer formed on one surface of the base, an insulating layer formed on the other surface of the base, and a biasing conductive layer formed on the insulating layer.

* * * * *